US005203289A

United States Patent [19]

Hara et al.

[11] Patent Number: 5,203,289

[45] Date of Patent: Apr. 20, 1993

[54] VARIABLE TIMING MECHANISM

[75] Inventors: Seinosuke Hara; Shoji Morita; Yoshihiko Yamada, all of Kanagawa, Japan

[73] Assignee: Atsugi Unisia Corporation, Kanagawa, Japan

[21] Appl. No.: 763,908

[22] Filed: Sep. 23, 1991

[30] Foreign Application Priority Data

| | | | |
|---|---|---|---|
| Sep. 21, 1990 | [JP] | Japan | 2-252703 |
| Sep. 27, 1990 | [JP] | Japan | 2-257750 |
| Sep. 27, 1990 | [JP] | Japan | 2-257751 |
| Nov. 27, 1990 | [JP] | Japan | 2-325083 |

[51] Int. Cl.[5] ..... F01L 1/34

[52] U.S. Cl. ..... 123/90.16; 123/90.39

[58] Field of Search ..... 123/90.15, 90.16, 90.17, 123/90.39, 90.4, 90.41, 90.44

[56] References Cited

U.S. PATENT DOCUMENTS

| | | | |
|---|---|---|---|
| 4,612,884 | 9/1986 | Ajiki et al. | 123/90.16 |
| 4,759,322 | 7/1988 | Konno | 123/90.16 |
| 4,768,467 | 9/1988 | Yamada et al. | 123/90.16 |
| 4,768,475 | 9/1988 | Ikemura | 123/90.16 |
| 4,901,685 | 2/1990 | Fukuo et al. | 123/90.16 |
| 5,042,437 | 8/1991 | Sakuragi et al. | 123/90.16 |
| 5,046,462 | 9/1991 | Matayoshi et al. | 123/90.16 |
| 5,080,054 | 1/1992 | Nakamura | 123/90.16 |
| 5,085,182 | 2/1992 | Nakamura et al. | 123/90.16 |

FOREIGN PATENT DOCUMENTS

| | | |
|---|---|---|
| 0420159 | 4/1991 | European Pat. Off. . |
| 61-31614 | 2/1986 | Japan . |
| 63154810 | 12/1986 | Japan . |
| 62-121811 | 6/1987 | Japan . |
| 63-124817 | 5/1988 | Japan . |

*Primary Examiner*—E. Rollins Cross
*Assistant Examiner*—Weilun Lo
*Attorney, Agent, or Firm*—Bachman & LaPointe

[57] ABSTRACT

An apparatus for use in a variable valve timing and/or valve lift system of an internal combustion engine is disclosed. The apparatus is easy to mount, install and adjust within a space available over a cylinder head of the engine. The apparatus comprises a rocker shaft, a first cam, a second cam, and a rocker arm pivotally mounted on the rocker shaft. The rocker arm includes a first cam follower arranged to engage the first cam and a second cam follower arranged to engage the second cam. The second cam follower is pivotally mounted on the rocker arm. A hydraulically operated locking bolt is movable from an unlocking position to a locking position. In the locking position, the locking bolt is received in bores formed in the rocker arm and in the second cam follower to establish a positive motion state wherein the rocker arm moves with said second cam follower as a unit. A mechanism includes a timing lever and restrains the locking bolt against at least moving out of the unlocking position to the locking position.

35 Claims, 19 Drawing Sheets

VARIABLE TIMING MECHANISM

RELATED UNITED STATES APPLICATION

U.S. patent application Ser. No. 07/587,939 filed on Sep. 25, 1990, now U.S. Pat. No. 5,085,182.

BACKGROUND OF THE INVENTION

The present invention relates to a valve actuating mechanism and more particularly to a variable valve timing and/or lift mechanism.

In such a mechanism, an apparatus is known which has a first rocker arm arranged to cooperate with a low engine speed cam and a second rocker arm arranged to cooperate with a high engine speed cam. The two rocker arms are pivotally mounted on a common rocker shaft. A hydraulically operated connection arrangement is provided which enables the first and second rocker arms to be selectively interlocked to move as a unit.

An object of the present invention is to improve an apparatus of the above kind such that a shift into the locking position is effected smoothly without causing any damage on the component parts.

SUMMARY OF THE INVENTION

According to the present invention, there is provided an apparatus comprising:

a rocker shaft;

a first cam;

a second cam;

a rocker arm pivotally mounted on said rocker shaft, said rocker arm including a first cam follower arranged to engage said first cam, said rocker arm including a second cam follower, said second cam follower being arranged to engage said second cam and pivotally mounted on said rocker arm;

means for connecting said second cam follower to said rocker arm for a unitary motion, said connecting means having a positive motion state wherein said rocker arm moves with said second cam follower as a unit as said second cam follower follows said second cam and a lost motion state wherein said rocker arm fails to move as a unit with said second cam follower, said connecting means being shiftable between said positive motion state and said lost motion state; and means for mechanically restraining said connecting means at least against shifting out of said lost motion state toward said positive motion state.

DETAILED DESCRIPTION OF THE INVENTION

Referring to FIGS. 1 to 12, a first embodiment of an appratus according to the present invention is described below.

Figure 1:
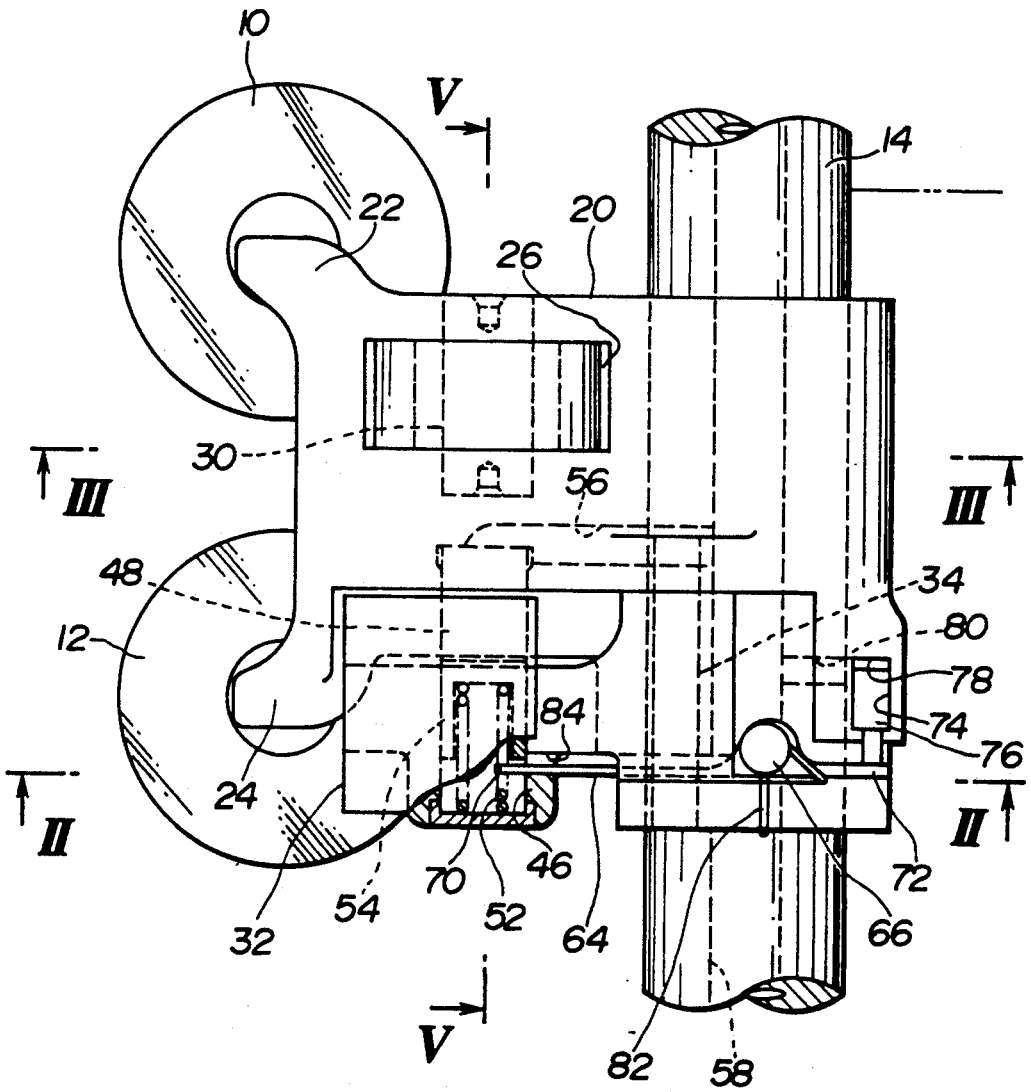
FIG. 1 is a plan view of a first embodiment of an apparatus according to the present invention.
Figure 2:
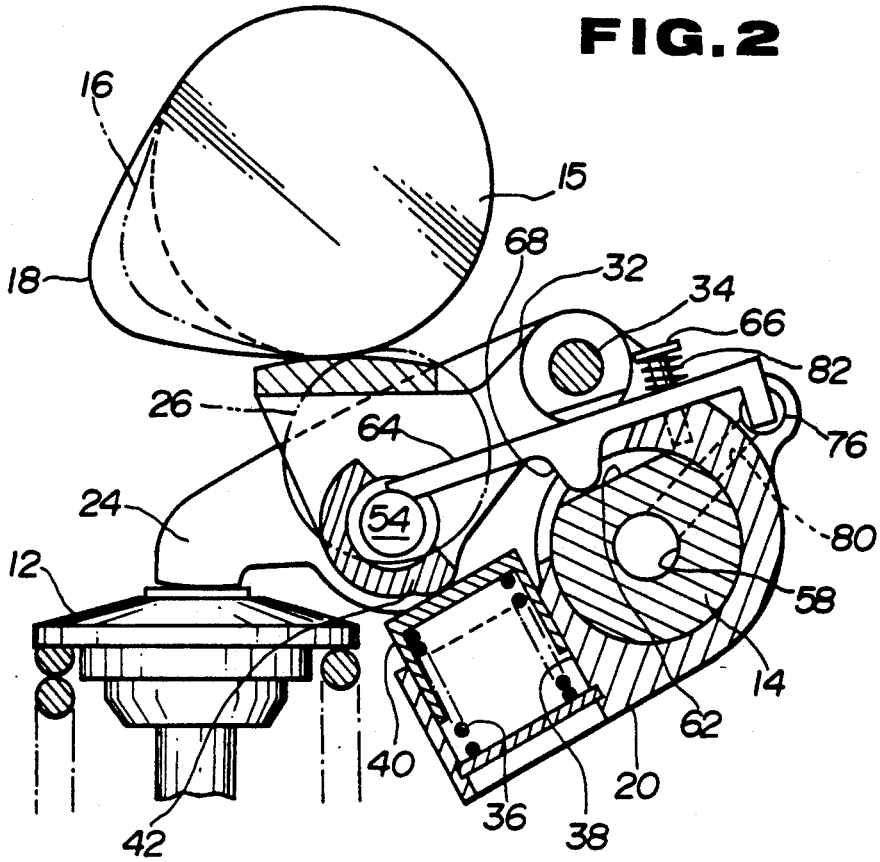
FIG. 2 is a section taken through the line 11—11 of FIG. 1.
Figure 3:
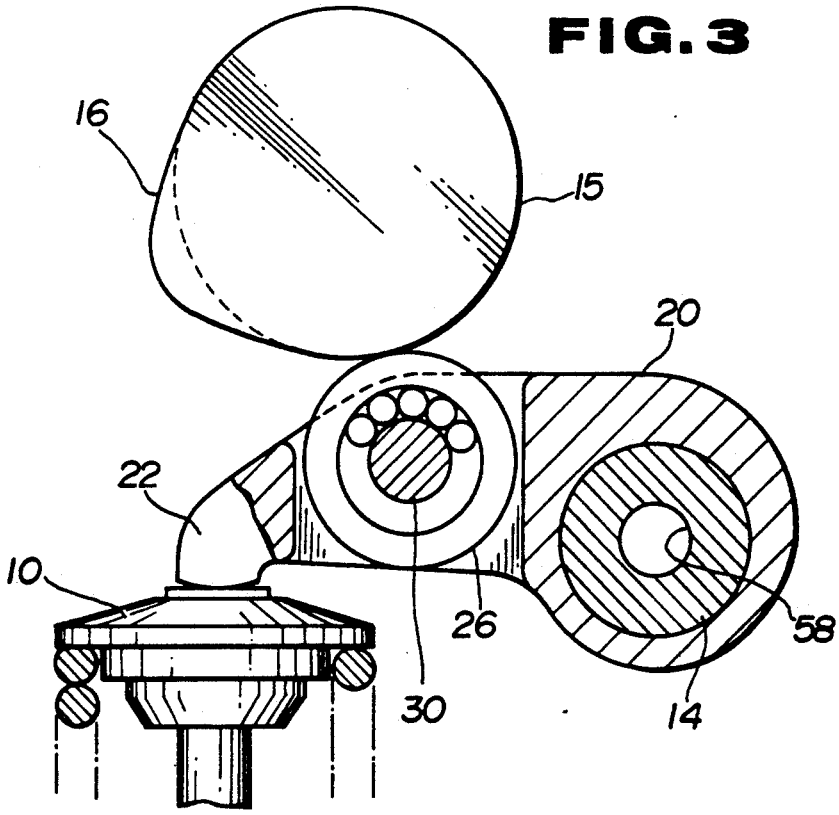
FIG. 3 is a section taken through the line III—III of FIG. 1, showing a position of parts when a rocker arm follows a base circle portion of a low speed cam.

Referring to FIG. 1, there are shown two intake valves 10 and 12, which may be two exhaust valves if desired, per each of cylinders of an internal combustion engine. A rocker shaft 14 is located adjacent the valves 10 and 12. Although not shown in FIG. 1, a camshaft 15 (see FIGS. 2 to 5) is located above the intake valves 10 and 12. Integrally formed on the camshaft 15 are a first low speed cam 16 (viz., a cam which is configured for low speed engine operation and for low valve lift operation) as shown in FIG. 3 and a second high speed cam 18 (viz. a cam which is configured for high speed engine operation and for high valve lift operation) as shown in FIG. 2. The low and high speed cams 16 and 18 are designed to produce the appropriate amount of valve lift and timing for low and high engine speed operation, respectively. The amount of valve lift and/or the length of time the valves 10 and 12 are opened by the high speed cam 18 are greater than those induced by the low speed cam 16.

Disposed between these cams 16 and 18 and stems of the intake valves 10 and 12 is a rocker arm 20 pivotally mounted on the rocker shaft 14. The rocker arm 20 has two arms 22 and 24 in abutting engagement with the stems of the valves 10 and 12, respectively. The rocker arm 20 includes a first cam follower in the form of a roller bearing 26 rotatably supported by a shaft 30 fixedly mounted to the rocker arm 20. The first cam follower 26 is arranged to engage the first low speed cam 16. The rocker arm 20 also includes a second cam follower 32 arranged to engage the second high speed cam 18. The second cam follower 32 is pivotally mounted on a pivot shaft 34 of the rocker arm 20.

As best seen in FIG. 2, a lost motion spring 36 is received in a bore 38 with which the rocker arm 20 is formed. In this embodiment, the lost motion spring 36 has one lower end engaging the blind end plate of the bore 38, while a retainer 40, which is reciprocatively disposed in the bore 38, encloses the other upper end of the lost motion spring 36. The second cam follower 32 has a lower tappet 42 engaging the retainer 40 for the lost motion spring 36.

Figure 5:
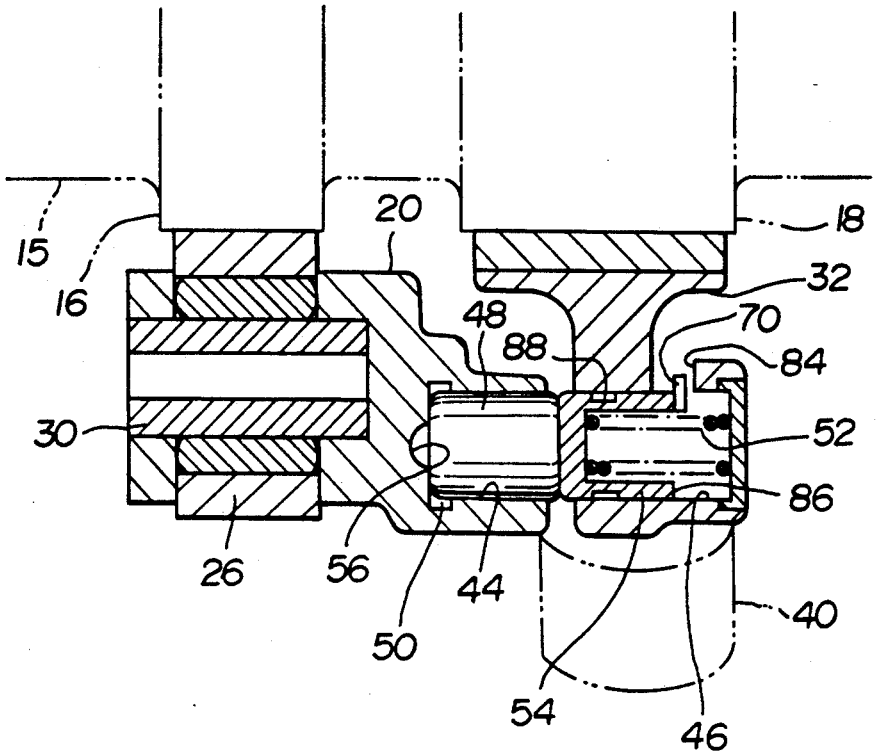
FIG. 5 is a section taken through the line V—V of FIG. 1, showing a lost motion state wherein a locking bolt is restrained against moving out of an unlocking position toward a locking position.
Figure 7:
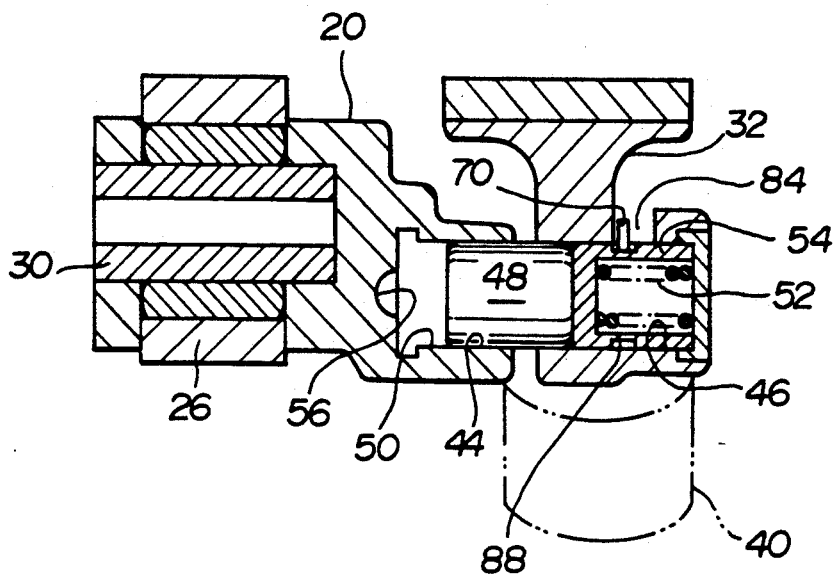
FIG. 7 is a similar view to FIG. 5, showing the positive motion state wherein the locking bolt is in the locking position.
Figure 8:
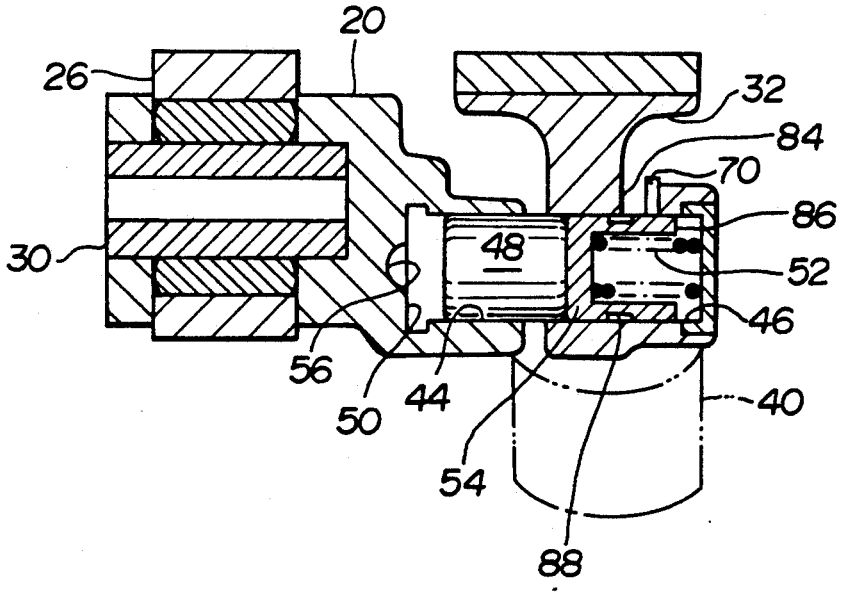
FIG. 8 is a similar view to FIG. 5, showing a transition from the positive motion state toward the lost motion state.
Figure 9:
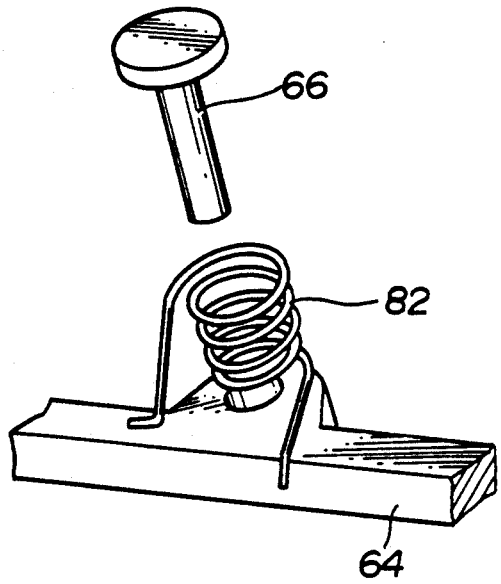
FIG. 9 is an exploded view of a portion of a timing lever, a pivot shaft and a spring.

An arrangement for selectively connecting the second cam follower 32 to the rocker arm 20 for a unitary motion is explained. This arrangement comprises a structure as shown in FIGS. 1 and 5. This structure includes a first bore 44 formed in the rocker arm 20, a second bore 46 formed in the second cam follower 32, and a hydraulically operated locking bolt 48 received in the first bore 44 to define therein a hydraulic chamber 50. The locking bolt 48 is movable between an unlocking position as shown in FIG. 5 wherein the locking bolt 40 is disengaged from the second bore 46 and a locking position as shown in FIG. 7 wherein the locking bolt 48 is inserted into the second bore 46. A return spring 52 is disposed in the second bore 46. The return spring 52 has one end engaging the blind end of the second bore and a spring retainer 54 is slidably disposed in the second bore 46 and encloses the other end of the return spring 52. Owing to the return spring 52, the spring retainer 54 is held in abutting engagement with the adjacent axial end of the locking bolt 48.

Owing to this structure, the connecting arrangement provides a positive motion state wherein the rocker arm 20 moves as a unit with the second cam follower 32 as the second cam follower 32 follows the second high speed cam 18, or a lost motion state wherein the rocker arm 20 fails to move as a unit with the second cam follower 32. In the lost motion state, the cam rocker arm 20 follows the first low speed cam 16 since the rocker arm 20 always moves as a unit with the first cam follower 26.

The hydraulic chamber 50 communicates via a passage 56 with an axial passage bore 58 with which the rocker shaft 14 is formed. This passage structure 56 and 58 provides fluid communication between the hydraulic chamber 50 and a non-illustrated control source. Briefly explaining, when a high speed engine operation is demanded, a hydraulic pressure prevails in the axial passage bore 58. This hydraulic pressure is supplied to the hydraulic chamber 50 to act on the locking bolt 48, causing the locking bolt 48 to move into the second bore 46 to take the locking position as shown in FIG. 7.

Figure 10:
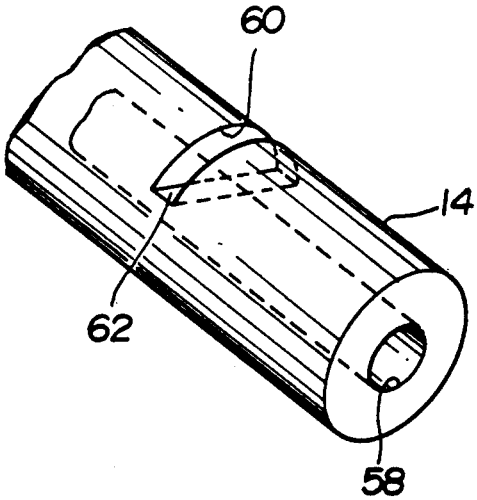
FIG. 10 is a perspective view of a portion of a rocker shaft, showing a bottom wall of a groove with which the rocker shaft is formed.

At least, movement of the locking bolt 48 from the unlocking position to the locking position is mechanically restrained by a mechanism. This mechanism includes a groove 60, with a bottom flat wall 62, formed in the rocker shaft as shown in FIGS. 2 and 10. It also includes a timing lever 64 pivotally mounted, with an appropriate amount of play, on a pivot shaft or pin 66 fixedly inserted into the rocker arm 20. The timing lever 64 has a downwardly projected follower portion 68 in engagement with or resting on the groove bottom wall 62. The timing lever 64 has one end portion 70 and an opposite end portion 72. The mechanism includes a piston receiving bore 74 (see FIG. 1) formed in the rocker arm 20, a hydraulically operated piston 76 received in this bore 74 and defining therein a second hydraulic chamber 78. The second hydraulic chamber 78 communicates via a passage 80 with the axial passage bore 58. A coil spring 82 encircles the pivot shaft 66 and has one end anchoring the rocker arm 20 and an opposite end anchoring the timing lever 64 (see FIGS. 1, 2 and 9). With this spring arrangement, the timing lever 64 is biased in one direction to maintain engagement of the follower portion 68 with the groove bottom wall 62, and it is subject to a torque in a second direction to maintain engagement of the opposite end portion 72 with the piston 76.

As seen in FIG. 1, the one end portion 70 of the timing lever 64 is inserted into the second bore 46 of the second cam follower 32 through a window 84 to cooperate with the spring retainer 54 encircling the return spring 52. In the position shown in FIG. 5 when the locking bolt 48 is in the unlocking position, the spring retainer 54 has an annular axial end 86 engaged by the one end portion 70 of the timing lever 64. The spring retainer 54 is formed with a circumferential groove 88 engageable with the one end portion 70 of the timing lever 64 when the locking bolt 48 is in the locking position as shown in FIG. 7.

Figure 4:
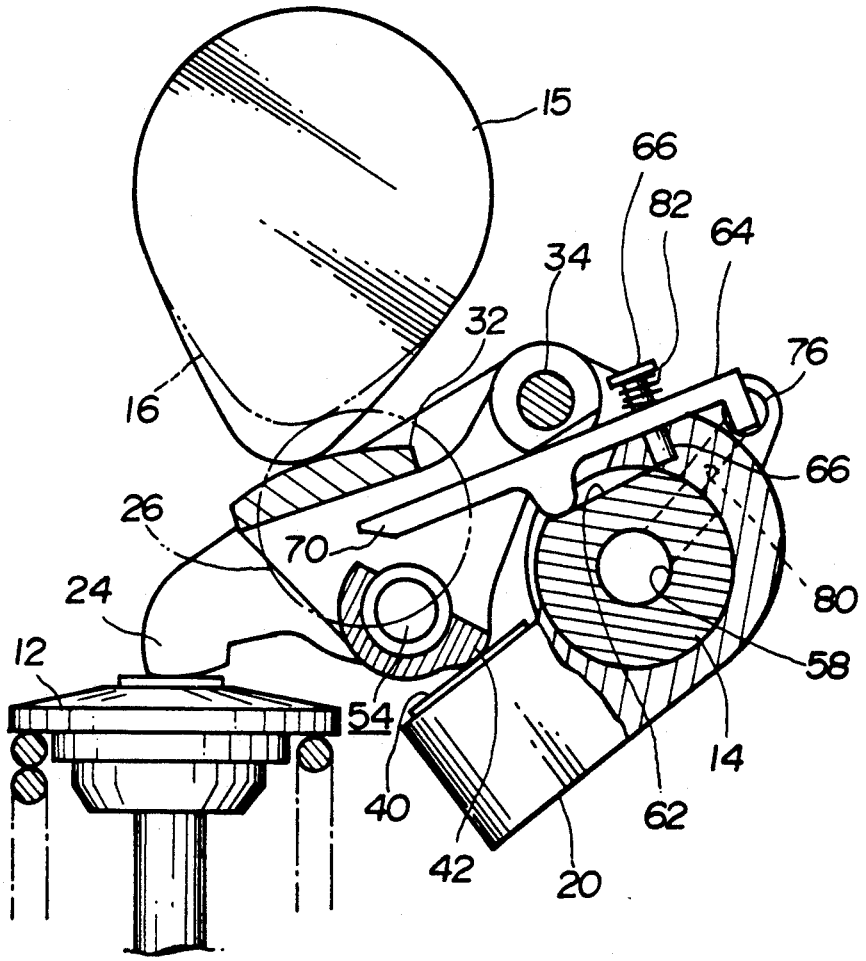
FIG. 4 is a similar view to FIG. 3, showing a position of parts when the rocker arm follows a cam lobe portion of the low speed cam and is angled relative to a rocker shaft.

As is readily seen from FIG. 4 in comparison with FIG. 2, the one end portion 70 of timing lever 64 is lifted relative to the rocker arm 20 during tilting of the rocker arm 20 owing to a change in the relationship of the groove bottom wall 62 with the follower portion 68 of the timing lever 64. Thus, the appropriate amount lift of the one end portion 70 of the timing lever 64 is induced during tilting motion of the rocker arm 20.

As will be appreciated, shift of the locking bolt 48 from the unlocking position as shown in FIG. 5 to the locking position as shown in FIG. 7 or vice versa is smoothly effected when the first and second cam followers 26 and 32 engage the base circle portions of the low and high speed cams 16 and 18, respectively.

The operation of the timing lever 64 is explained below.

Figure 6:
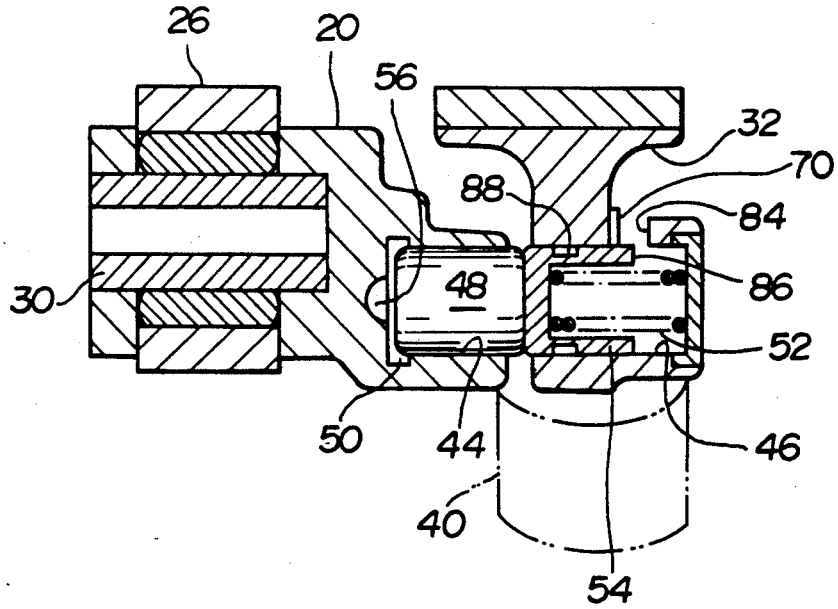
FIG. 6 is a similar view to FIG. 5, showing a transition from the lost motion state toward a positive motion state.

FIG. 1 shows a position of parts when there is no hydraulic fluid pressure supplied to the hydraulic chamber 50 behind the locking bolt 48 and the second hydraulic chamber 78 behind the piston 76 and the first and second cam followers 26 and 32 engage the base circle portions of the low and high speed cams 16 and 18, respectively. If there is a demand for shift from low engine speed operation to high engine speed operation, a hydraulic fluid pressure is supplied to the hydraulic fluid chambers 50 and 78 simultaneously. This causes the piston 76 to project to turn the timing lever 64 about the pivot shaft 66 clockwise viewing in FIG. 1, bringing the one end portion 70 of the timing lever 64 into abutting engagement with the annular end 86 of the spring retainer 54 as shown in FIG. 5. This restrains or prevents movement of the locking bolt 48 from the unlocking position toward the locking position. When, subsequently, the first and second cam followers 26 and 32 follow radially extending cam lobe portions of the low and high speed cams 16 and 18, the one end portion 70 of the timing lever 64 is lifted and disengaged from the annular end 86 of the spring retainer 54 and held on the adjacent wall of the second cam follower owing to the action of the piston 76. In this state, the insertion of the locking bolt 48 into the second bore 46 is prevented since the second bore 46 is out of axial alignment with the first bore 44 in which the locking bolt 48 is disposed. The second bore 46 comes into alignment with the first bore 44 as shown in FIG. 6 when the first and second cam followers 26 and 32 engage the base circle portions of the low and high speed cams 16 and 18 again. Then, since the one end portion 70 of the timing lever 64 rides on the circumferential wall of the spring retainer 54, the locking bolt 48 moves into the second bore 46 against the action of the return spring 52 to the locking position as shown in FIG. 7. In the position of FIG. 7, owing to the action of the spring 82, the one end portion 70 of the timing lever 64 engages into the circumferential groove 88 of the spring retainer 54.

If, in the state as shown in FIG. 7, the hydraulic fluid pressure supplied to the hydraulic chambers 50 and 78 drops to zero, since the one end portion is left engaged in the circumferential groove 88 of the spring retainer 54 when the first and second cam followers 26 and 32 engage the base circle portions of the low and high speed cams 16 and 18. During the subsequent tilting operation of the rocker arm to open the intake valves 10 and 12 against their valve springs, the one end portion 70 of the timing lever 64 is lifted to disengage from the circumferential groove 88 of the spring retainer 54 to ride on the circumferential wall thereof and shifted toward the blind end of the second bore 46 owing to the action of the spring 82 since the piston 76 has ceased its operation. However, the owing to the action of the valve springs, the locking bolt sticks and thus stay in the locking position. When the first and second cam follower portions 26 and 32 engage the base circle portions of the low and high speed cams 16 and 18 again, the locking bolt 48 moves, under the bias of the return spring 52, out of the second bore 46 (see FIG. 8) toward the unlocking position as shown in FIG. 1.

From the preceding description, it will now be appreciated that with the timing lever 64, the initiation of the shift of the locking bolt 48 is appropriately controlled and smooth shift is always assured.

Figure 11:
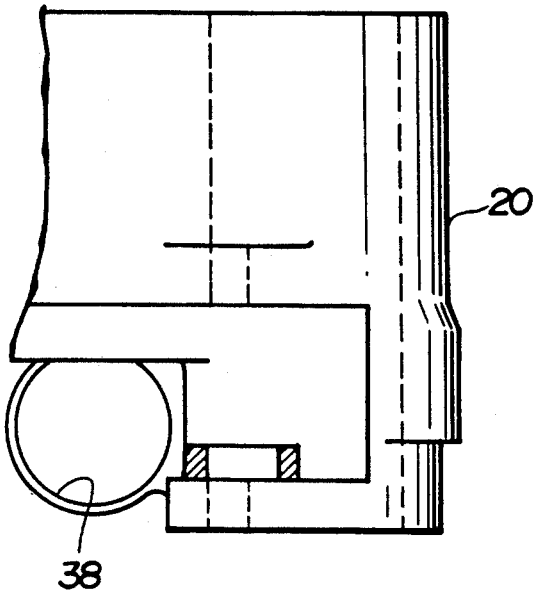
FIG. 11 is a plan view of a portion of the rocker arm with the associated parts removed.
Figure 12:
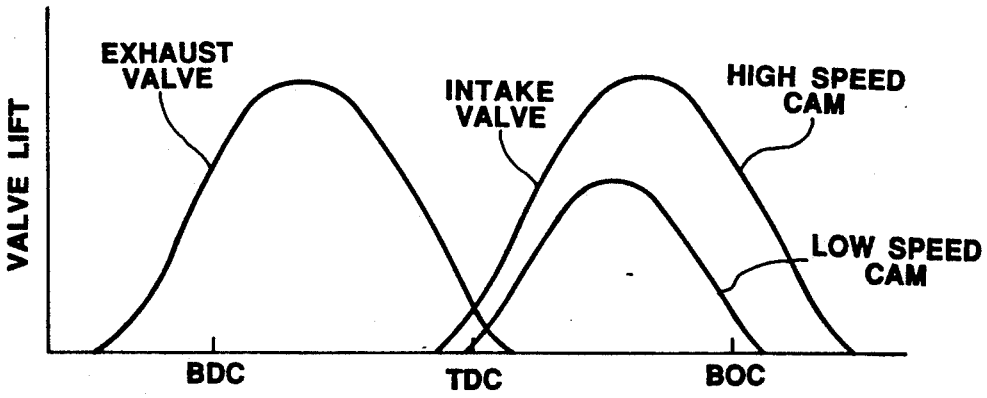
FIG. 12 is a valve lift diagram of two intake valves in comparison with two exhaust valves.
Figure 13:
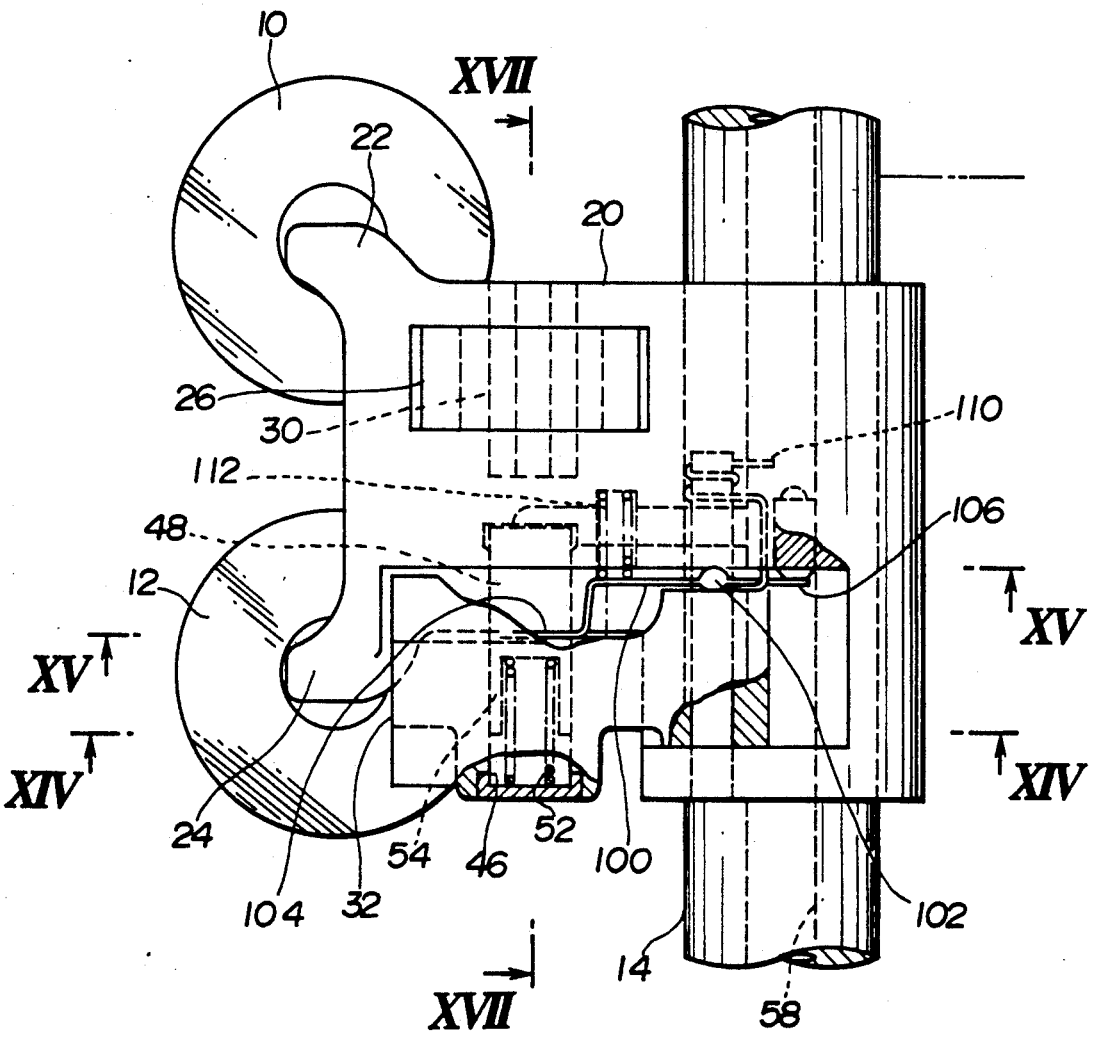
FIG. 13 is a similar view to FIG. 1, showing a second embodiment of an apparatus according to the present invention.
Figure 14:
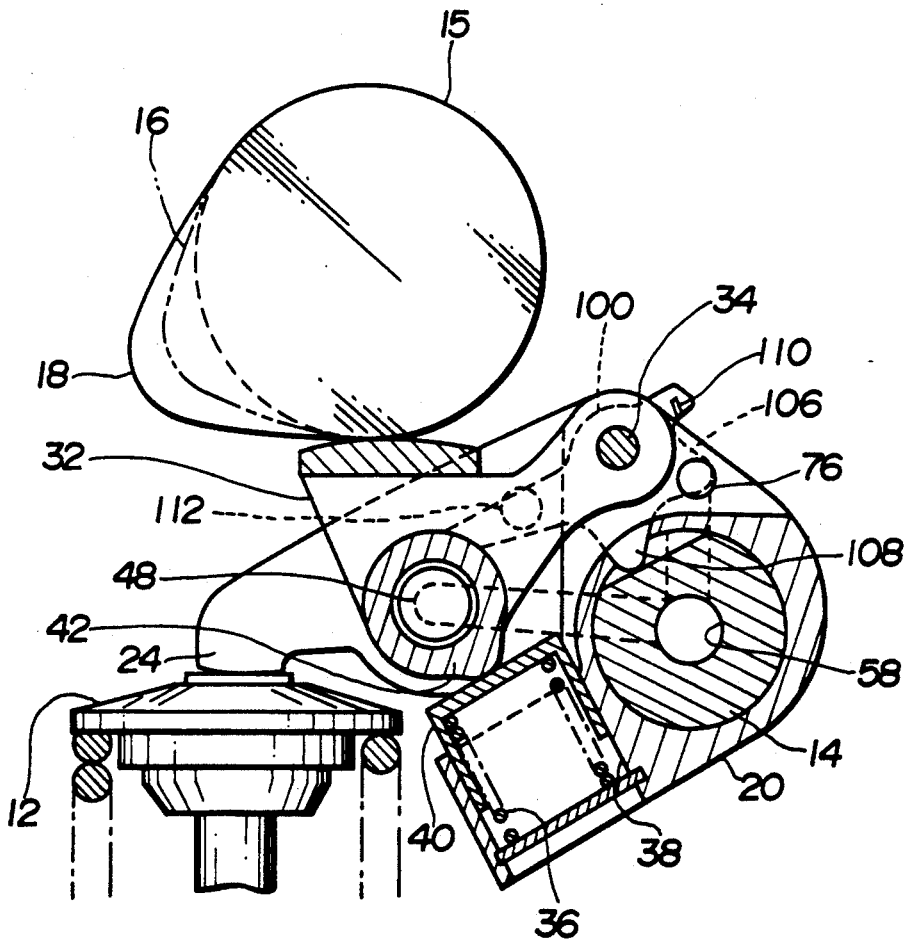
FIG. 14 is a section taken through the line XIV—XIV of FIG. 13.
Figure 15:
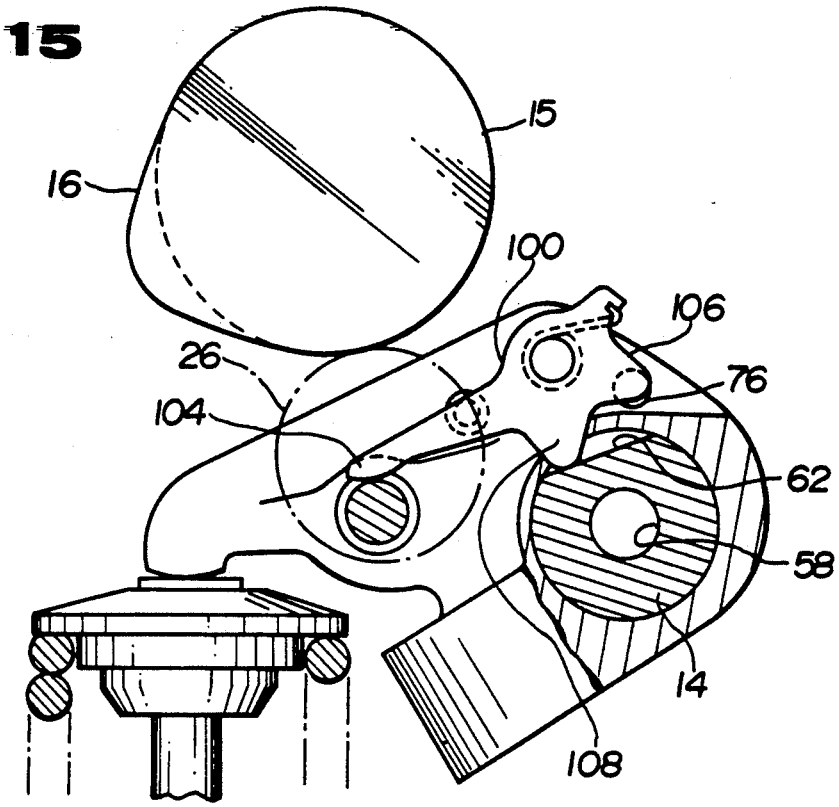
FIG. 15 is a section taken through the line XV—XV of FIG. 13, showing a position of parts when a rocker arm follows a base circle portion of a low speed cam.
Figure 16:
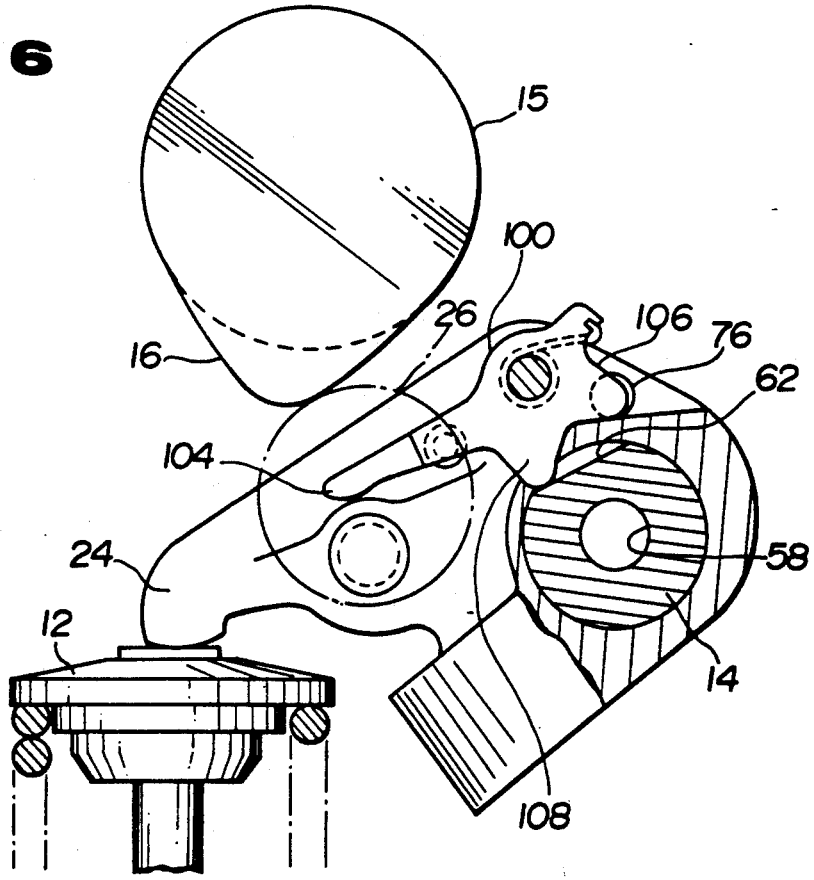
FIG. 16 is a similar view to FIG. 15, showing a position of parts when the rocker arm follows a cam lobe portion of the low speed cam and is angled relative to a rocker shaft.

FIG. 11 is a fragmentary view of the rocker arm 20 to show the bore 38 for the lost motion spring 36. FIG. 12 is a valve lift diagram of the intake valve provided by the low speed cam 16 and high speed cam 18.

A second embodiment is explained in connection with FIGS. 13 to 20.

Figure 17:
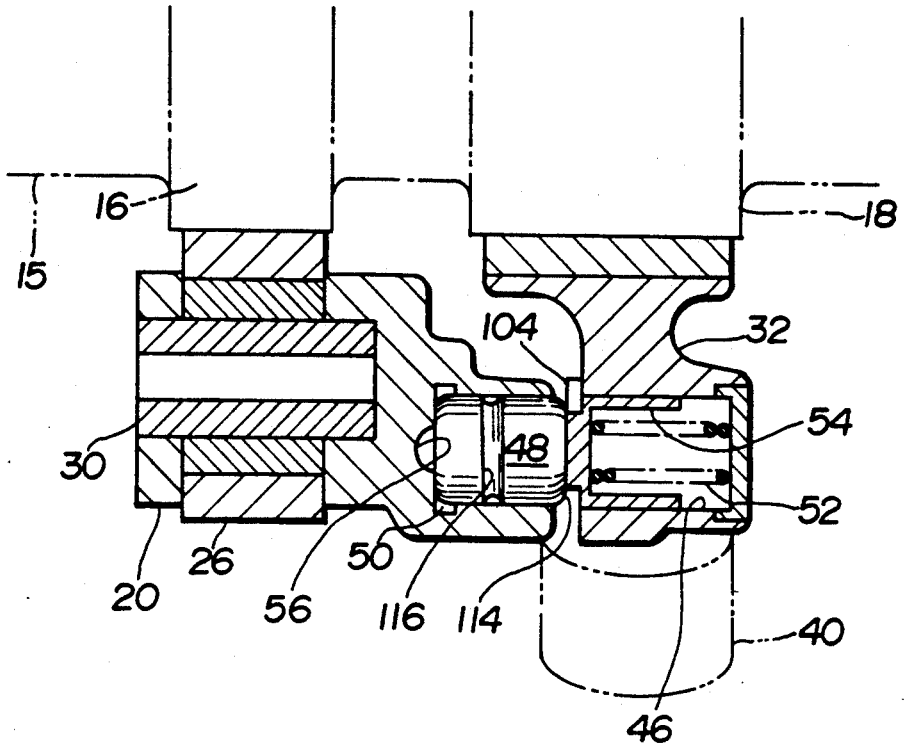
FIG. 17 is a section taken through the line XVII—XVII of FIG. 13, showing a lost motion state wherein a locking bolt is restrained against moving out of an unlocking position toward a locking position.
Figure 18:
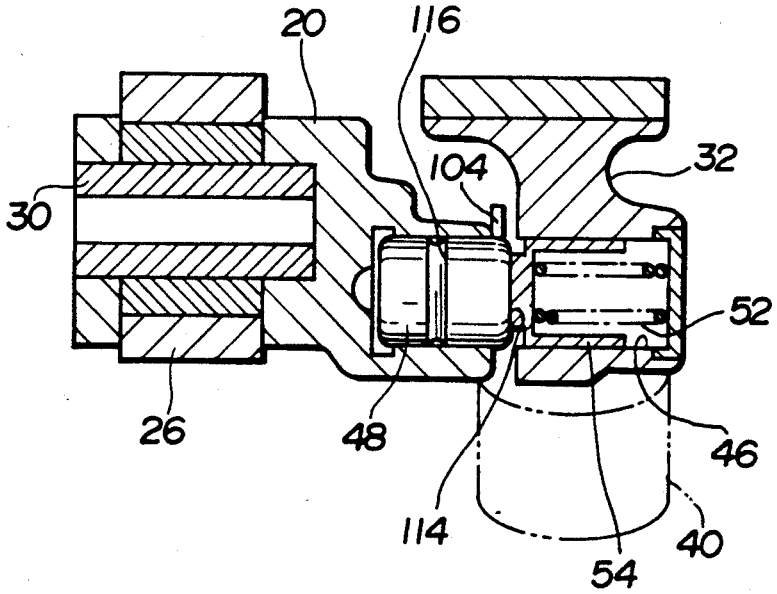
FIG. 18 is a similar view to FIG. 17, showing a transition from the lost motion state toward a positive motion state.
Figure 19:
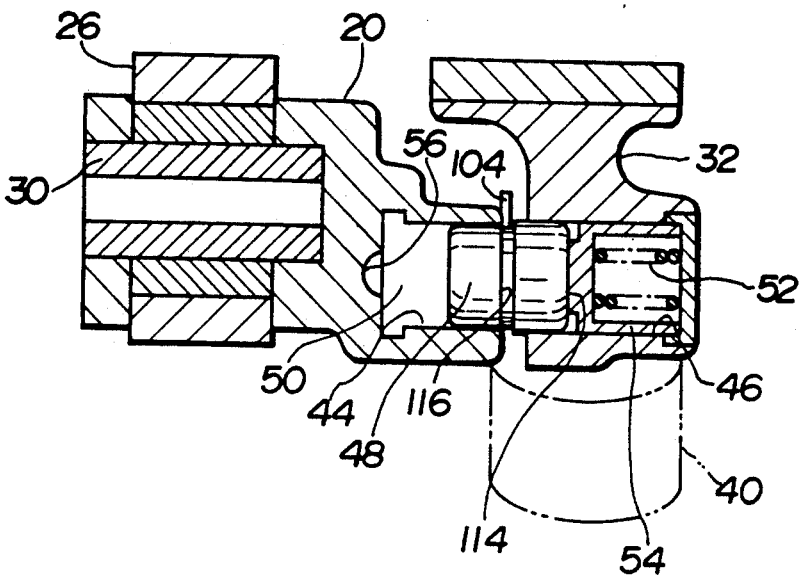
FIG. 19 is a similar view to FIG. 17, showing the positive motion state wherein the locking bolt is in the locking position.
Figure 20:
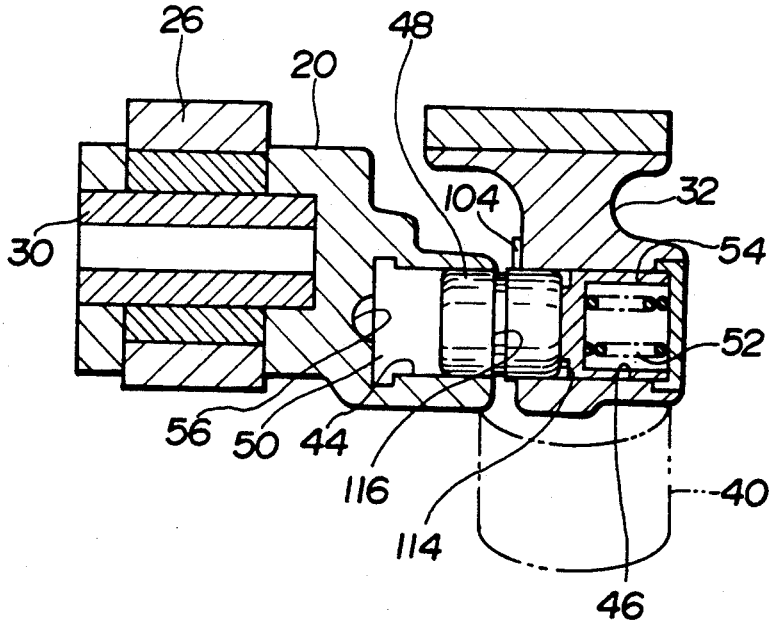
FIG. 20 is a similar view to FIG. 17, showing a transition from the positive motion state toward the lost motion state.
Figure 21:
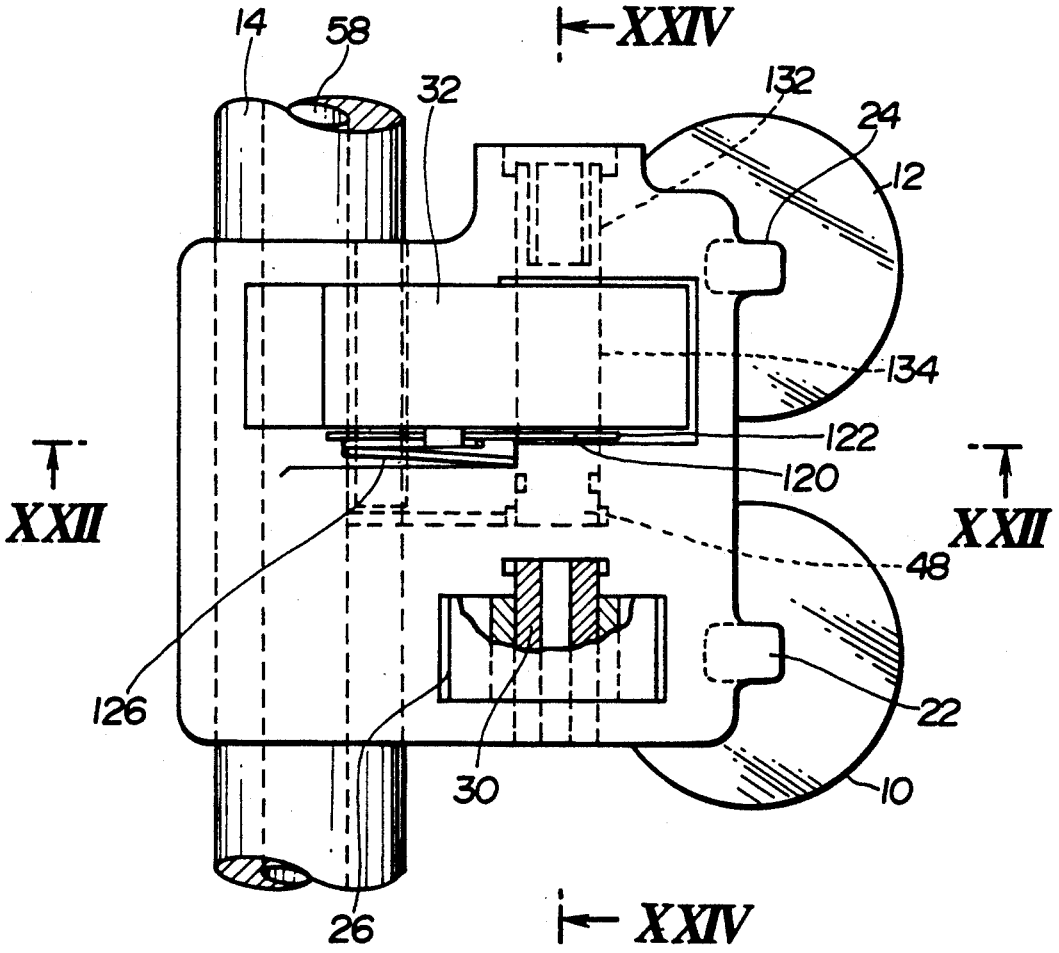
FIG. 21 is a plan view of a third embodiment of an apparatus according to the present invention.

This second embodiment is substantially the same as the first embodiment in operation. Thus the same reference numerals are used in this second embodiment to designate like or similar parts or portions to those of the first embodiment. However, the second embodiment is different from the first embodiment in that a timing lever 100 is disposed between the opposed spaced walls of a rocker arm 20 and a second cam follower 32, respectively, and pivotally mounted on a pivot shaft 34 on which the second cam follower 32 is pivotally mounted. The timing lever 100 has a pivot portion formed with a rounded projected portion 102 disposed between the above-mentioned opposed spaced walls. The timing lever 100 is pivotally mounted on the pivot shaft 34 in such a manner for a limited swingable movement to allow shift of its one end portion 104 along an axial direction of a rocker shaft 14. The rounded projected portion 102 facilitates this movement. Similarly to the first embodiment, an opposite end portion 106 of the timing lever 100 rests on a hydraulically operated piston 76 and a follower portion 108 of the timing lever 100 engages a bottom wall 62 of a groove 60 with which the rocker shaft 14 is formed. Different from the single spring 82 used in the first embodiment, two springs are used to bias the timing lever 100. Among the two springs, a first spring 110 encircles the pivot shaft 34 fixedly mounted to the rocker arm 20 and has one end anchoring the rocker arm 20 and an opposite end anchoring the timing lever 100 to bias said timing lever 100 in a direction to maintain engagement of the follower portion 108 with the groove bottom wall 62. A second spring 112 bears between the timing lever 100 and the rocker arm 20 to bias the timing lever 100 in a second direction to maintain engagement of the opposite end portion 106 with the piston 76. Different from the first embodiment, a hydraulically operated locking bolt 48 directly cooperates with the one end portion 104 of the timing lever 100. As best seen in FIG. 17, the locking bolt 48 has one end 114 engageable with the one end portion 104 of the timing lever 100 when the locking bolt 48 is in the unlocking position. The locking bolt 48 is formed with a circumferential groove 116 which is engageable with one end portion 104 of the timing lever 100 when the locking bolt 48 is in the locking position as shown in FIG. 19. The operation of the timing lever 100 is the same as the operation of the timing lever 64 of the first embodiment. Similarlity will be readily recognized from comparing FIGS. 15, 16 and 17 to 20 with the corresponding FIGS. 2, 4 and 5 to 8, respectively.

A third embodiment is explained in connection with FIGS. 21 to 25.

In the first and second embodiments, the timing levers 64 and 100 are actuated by the hydraulically operated piston 76 and lifted by the groove bottom wall 62 of the rocker shaft 14.

Figure 22:
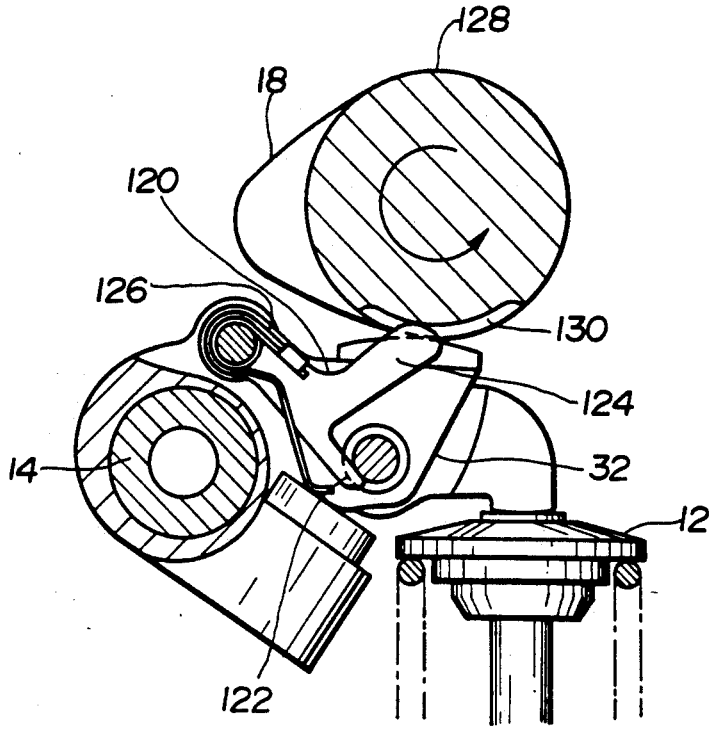
FIG. 22 is a section taken through the line XXII—XXII of FIG. 21, showing a position of parts when a timing lever follows a bottom wall of a groove with which a high speed cam is formed.
Figure 23:
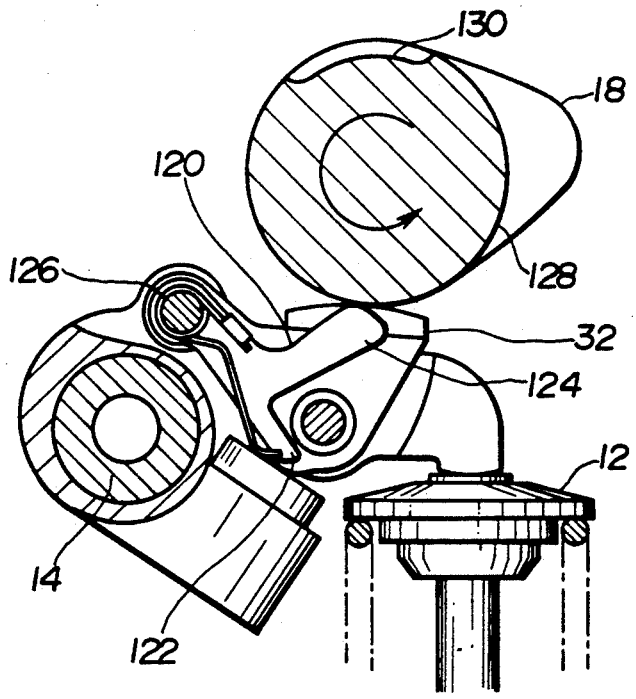
FIG. 23 is a similar view to FIG. 22, showing a position of parts when the timing lever follows the base circle portion of the high speed cam.

In third embodiment, a timing lever 120 is actuated in a less complicated manner. The timing lever 120 is disposed adjacent a second cam follower 32 and pivotally mounted on a pivot shaft 34 on which the second cam follower 32 is pivotally mounted. As shown in FIGS. 22 and 23, the timing lever 120 has one end portion 122 and a follower portion 124 engaging a base circle portion 128 of a high speed cam 18 which the second cam follower 32 engages. A spring 126 encircling the pivot shaft 34 biases the timing lever 120 clockwise viewing in FIGS. 22 and 23 to maintain engagement of the follower portion 124 with the base circle portion 128 of the cam 18. The base circle portion 128 is formed with a circumferential groove 130. When the follower portion 124 engages the base circle portion 128 the one end portion 122 is disengaged from a locking bolt 48, while when the follower portion 124 engages in the circumferential groove 130, the one end portion 122 is engageable with the locking bolt 48. In order to prevent the shift of the locking bolt 48 during a period of one cycle of cam operation when the valve lift operation is about to start, the location and length of the circumferential groove 130 is determined.

Figure 24:
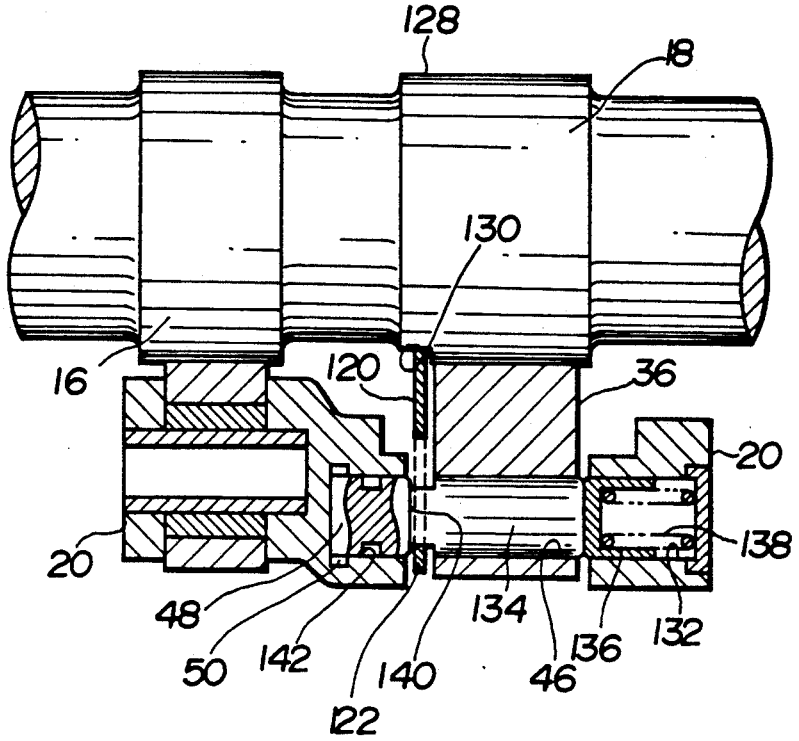
FIG. 24 is a section taken though the line XXIV—XXIV of FIG. 21, showing a lost motion state wherein a locking bolt is in the unlocking position.
Figure 25:
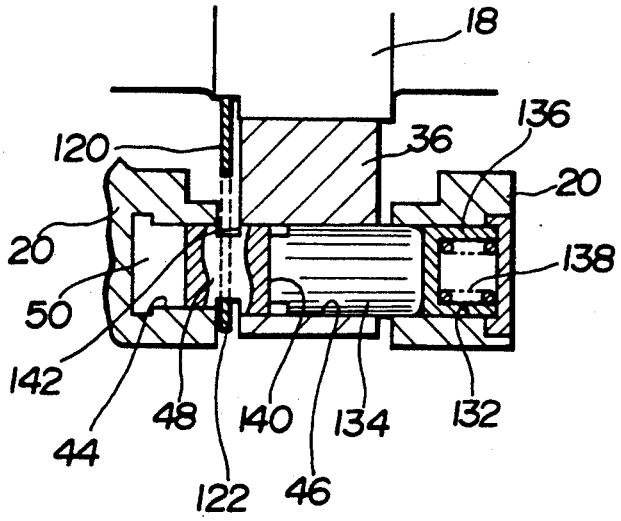
FIG. 25 is a similar view to FIG. 24, showing a positive motion state wherein the locking bolt is in the locking position.
Figure 26:
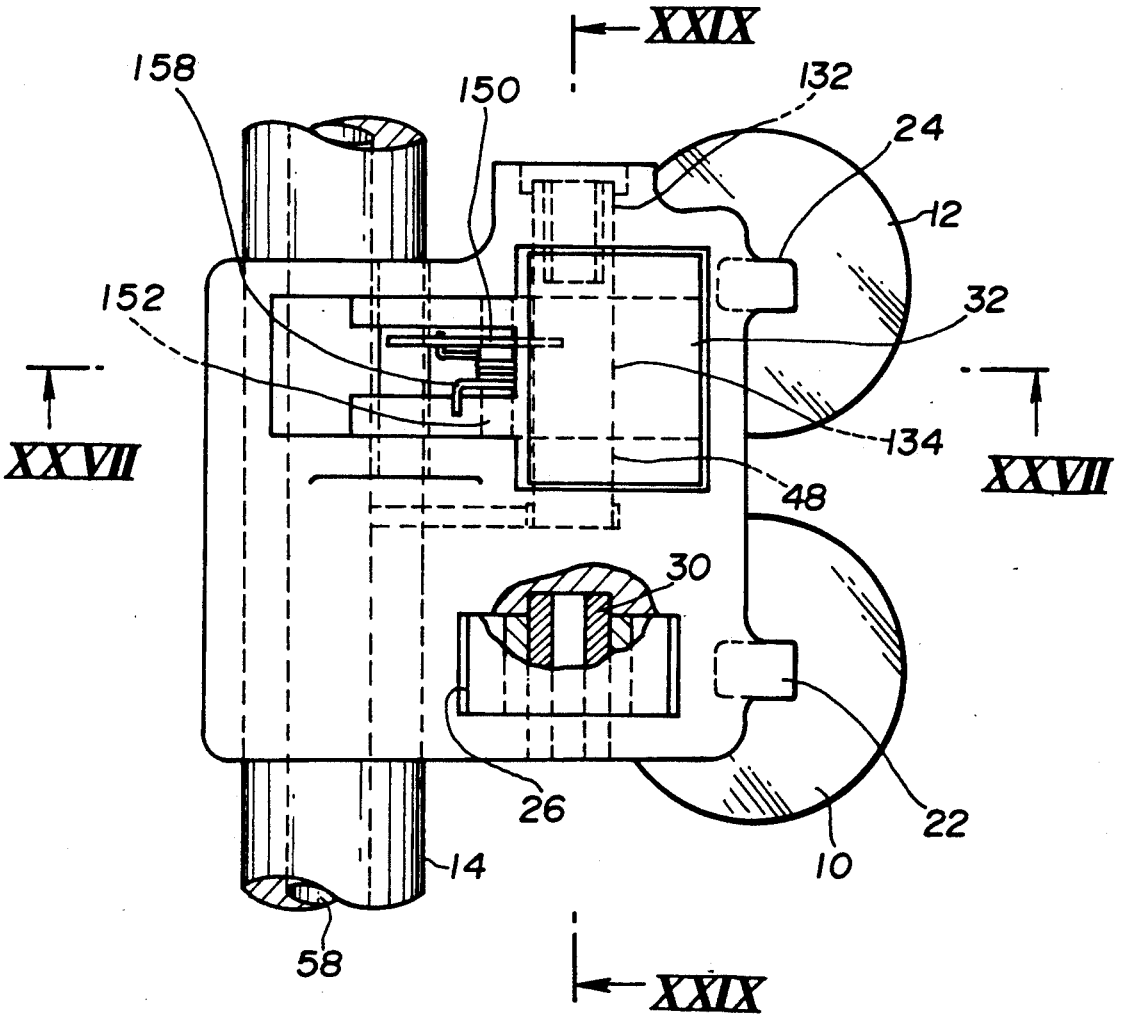
FIG. 26 is a similar view to FIG. 21, showing a fourth embodiment of an apparatus according to the present invention.

Different from the first and second embodiments, a second bore 46 is a through bore and a third bore 132 is formed in a rocker arm 20. The third bore 132 and a first bore 44 are axially aligned since they are formed in the rocker arm 20, the second bore 46 is axially aligned with the first and third bores 44 and 132 only when first and second cam followers 26 and 32 engage the base circle portions of low and high speed cams 16 and 18, respectively. A plunger 134 is slidably disposed in the second bore 46 and disposed between the locking bolt 48 and a spring retainer 136 is disposed in the third bore 132. A return spring 138 is disposed in the third bore 132. FIGS. 24 and 25 correspond to FIGS. 17 and 19. In FIG. 24, the one end portion 122 of the timing lever 120 engages an axial end 140 of the locking bolt 48 to prevent shift of the locking bolt 48 from its unlocking position during the period of time when the follower portion 124 of the timing lever 120 engahes the groove 130. In FIG. 25, the one end portion 122 of the timing lever engages a circumferential groove 142 of the locking bolt to prevent shift of the locking bolt from the locking position during the period of time when the follower portion 124 engages the groove 130.

A fourth embodiment is explained in connection with FIGS. 26 to 32.

Figure 27:
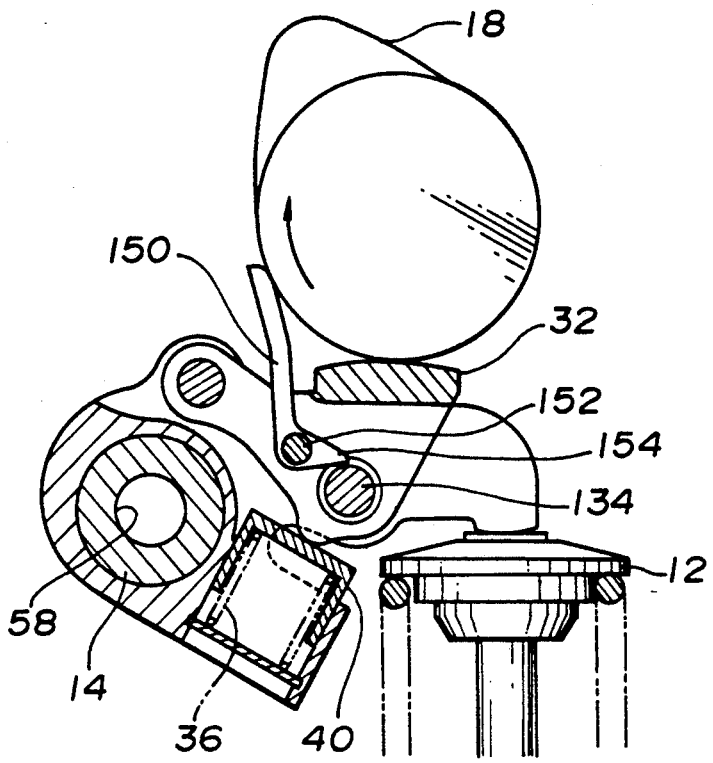
FIG. 27 is a section taken through the line XXVII—XXVII of FIG. 26, showing a position of parts when a timing lever follows the base circle portion of a high speed cam.
Figure 28:
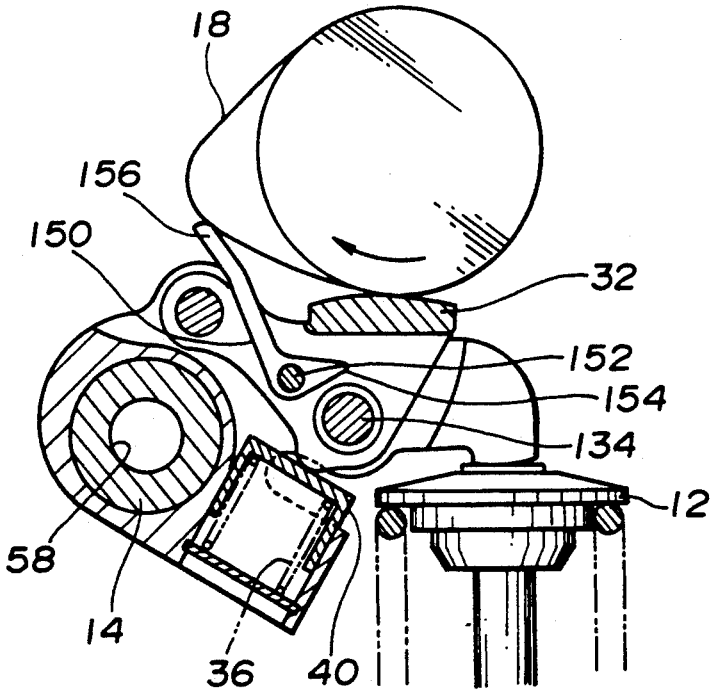
FIG. 28 is a similar view to FIG. 27, showing a position of parts when the timing lever follows a lobe portion of the high speed cam.

This fourth embodiment is similar to the third embodiment. However, the fourth embodiment is different from the third embodiment in that a timing lever 150 is pivotally mounted on a shaft 152 of a second cam follower 32. The timing lever 150 has one end portion 154 and a follower portion 156 engaging a high speed cam 18 at a different portion from a portion where the second cam follower 32 engages the high speed cam 18. A spring 158 is arranged to bias the timing lever 150 to maintain engagement of the follower portion 156 with the high speed cam 18. The arrangement of the timing lever 150 is such that when the follower portion 156 engages the base circle portion of the high speed cam 18, the one end portion engages a plunger 134 as shown in FIG. 27, while when the follower portion 156 engages relatively high lift portion of the high speed cam 18, the one end portion is fully disengaged from the plunger 134 as shown in FIG. 28. The timing lever 150 is arranged with respect to the second cam follower 32 such that the one end portion is disengaged from the plunger 134 during a period of time after the second cam follower 32 initiates engagement with the base circle portion immediately after trailing portion of the valve lift operation.

Figure 29:
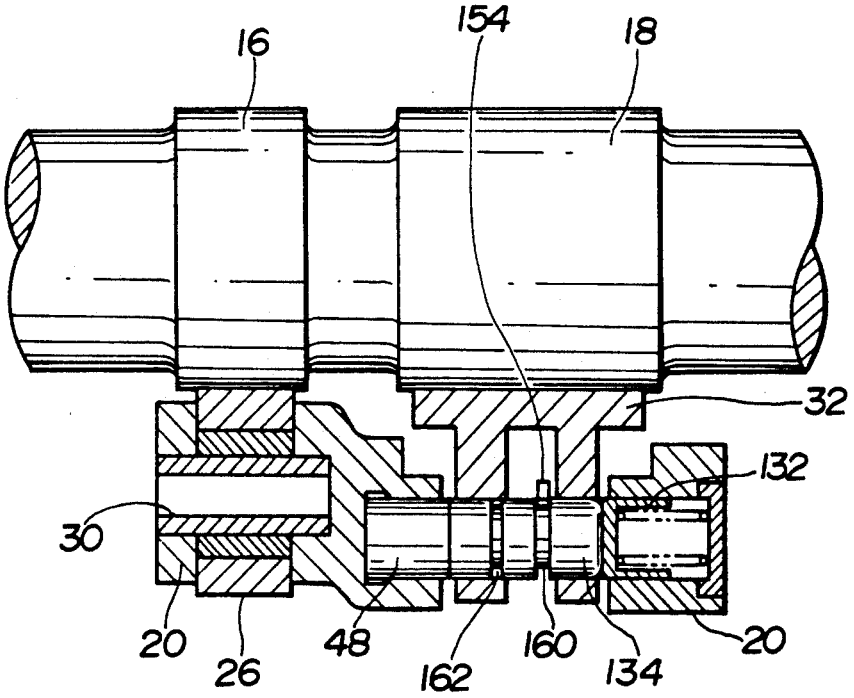
FIG. 29 is a section taken through the line XXIX—XXIX of FIG. 26, showing a lost motion state wherein a locking bolt is in an unlocking position.
Figure 30:
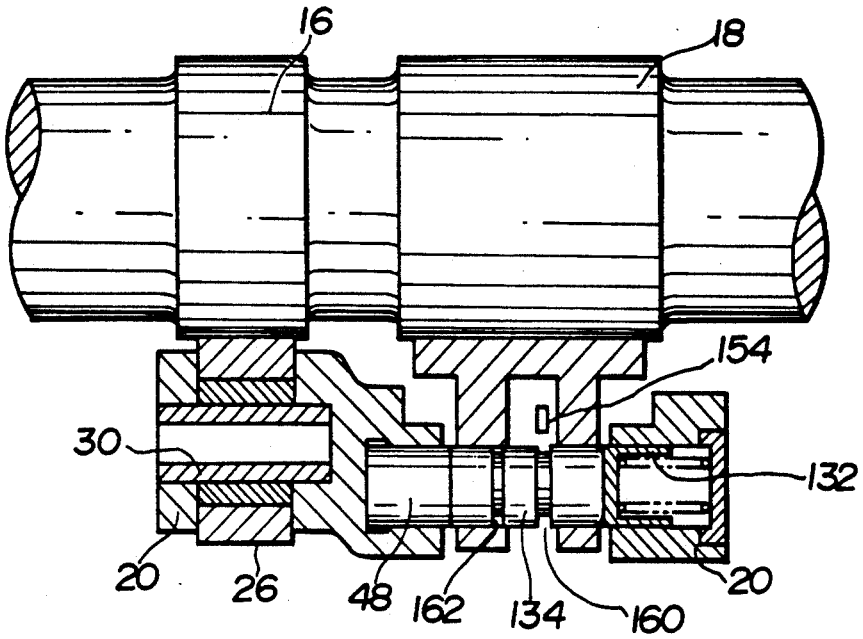
FIG. 30 is a similar view to FIG. 29, showing a transition from the lost motion state to a positive motion state.
Figure 31:
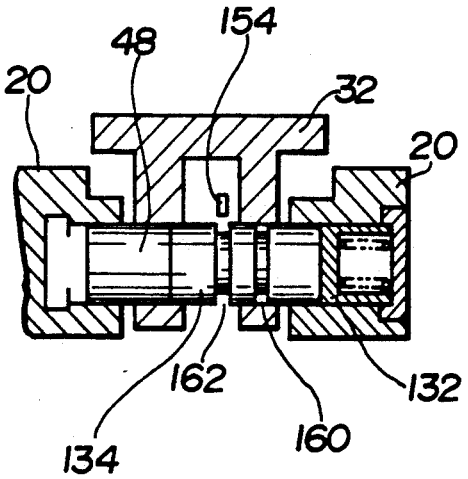
FIG. 31 is a similar view to FIG. 29, showing the positive motion state wherein the locking bolt is in the locking position.

FIG. 29 shows the unlocking position of parts wherein the one end portion engages a circumferential groove 160 of the plunger 134 with the follower portion 156 of the timing lever engaging the base circle portion of high speed cam 18. FIG. 30 is the unlocking position of the part wherein the one end portion 154 is disengaged out of the groove 160 of the plunger 134 during the above mentioned period, while FIG. 31 is the locking position wherein the one end portion is disengaged from a circumferential groove 162 of the plunger 134. It will be noted that a shift of the locking bolt 48 is possible from one of the positions shown in FIGS. 30 and 31.

What is claimed is:

1. An apparatus comprising:

a rocker shaft;

a first cam;

a second cam;

a rocker arm pivotally mounted on said rocker shaft, said rocker arm including a first cam follower arranged to engage said first cam, said rocker arm including a second cam follower, said second cam follower being arranged to engage said second cam;

means for connecting said second cam follower to said rocker arm for a unitary motion, said connecting means having a positive motion state wherein said rocker arm moves with said second cam follower as a unit as said second cam follower follows said second cam and a lost motion state wherein said rocker arm fails to move as a unit with said second cam follower, said connecting means being shiftable between said positive motion state and said lost motion state;

wherein said connecting means includes a first bore formed in said rocker arm, a second bore formed in said second cam follower, a hydraulically operated locking bolt received in said first bore to define therein a hydraulic chamber, said locking bolt movable between an unlocking position wherein said locking bolt is disengaged from said second bore and a locking position wherein said locking bolt is inserted into said bore, and means for resiliently biasing said locking bolt toward said unlocking position;

means for mechanically restraining said connecting means at least against shifting out of said lost motion state toward said positive motion state; and wherein said mechanically restraining means includes a groove formed in said rocker shaft and having a bottom wall, a timing lever mounted on said rocker arm and having a follower portion in engagement with said bottom wall, a spring arrangement for biasing said timing lever in a first direction to maintain said follower portion of said timing lever in engagement with said bottom wall and biasing said timing lever in a second direction, a piston receiving bore formed in said rocker arm, a hydraulically operated piston received in said piston receiving bore and defining therein a second hydraulic chamber, said hydraulically operated piston being arranged to engage said timing lever and subject to a bias of said spring arrangement in said second direction.

2. An apparatus as claimed in claim 1, wherein said timing lever has one end portion and an opposite end portion engage by said hydraulically operated piston.

3. An apparatus as claimed in claim 2, wherein said means for resiliently biasing said locking bolt toward said unlocking position includes a spring retainer slidably disposed in said second bore and a return spring disposed in said second bore and acting on said spring retainer.

4. An apparatuses as claimed in claim 3, wherein said spring retainer is in abutting engagement with said locking bolt.

5. An apparatus as claimed in claim 4, wherein said spring retainer cooperates with said one end portion of said timing lever.

6. An apparatus as claimed in claim 5, wherein said spring retainer has one end engageable with said one end portion of said timing lever when said locking bolt is in said unlocking position.

7. An apparatus as claimed in claim 6, wherein said spring retainer is formed with a groove engageable with said one end portion of said timing lever when said locking bolt is inserted into said second bore and in said locking position.

8. An apparatus as claimed in claim 7, wherein said mechanically restraining means includes a pivot shaft fixedly mounted to said rocker arm adjacent said rocker shaft.

9. An apparatus as claimed as in claim 8, wherein said timing lever is formed with an opening for loosely receiving said pivot shaft, and said spring arrangement includes a spring encircling said pivot shaft, said spring having one end anchoring said rocker arm and an opposite end anchoring said timing lever.

10. An apparatus as claimed in claim 4, wherein said rocker arm has a pivot shaft and said second cam follower is pivotally mounted on said pivot shaft of said rocker arm.

11. An apparatus as claimed in claim 10, wherein said timing lever is loosely pivotally mounted on said pivot shaft of said rocker arm.

12. An apparatus as claimed in claim 11, wherein said timing lever is disposed between said second cam follower and said rocker arm.

13. An apparatus as claimed in claim 12, wherein said locking bolt cooperates with said one end portion of said timing lever.

14. An apparatus as claimed in claim 13, wherein said locking bolt has one end engageable with said one end portion of said timing lever when said locking bolt is in said unlocking position.

15. An apparatus as claimed in claim 14, wherein said locking bolt is formed with a groove engageable with said one end portion of said timing lever when said locking bolt is inserted into said second bore and in said locking position.

16. An apparatus as claimed in claim 15, wherein said spring arrangement includes a first spring encircling said pivot shaft of said rocker arm, having one end anchoring said rocker arm and an opposite end anchoring said timing lever to produce a bias acting on said timing lever in said first direction, and said spring arrangement also includes a second spring bearing between said timing lever and said rocker arm to produce a bias acting on said timing lever in said second direction.

17. An apparatus according to claim 1 wherein the second cam follower is pivotally mounted on said rocker arm.

18. An apparatus comprising:

a rocker shaft;

a first cam;

a second cam;

a rocker arm pivotally mounted on said rocker shaft, said rocker arm including a first cam follower arranged to engage said first cam, said rocker arm including a second cam follower, said second cam follower being arranged to engage said second cam;

means for connecting said second cam follower to said rocker arm for a unitary motion, said connecting means having a positive motion state wherein said rocker arm moves with said second cam follower as a unit as said second cam follower follows said second cam and a lost motion state wherein said rocker arm fails to move as a unit with said a second cam follower, said connecting means being shiftable between said positive motion state and said lost motion state;

means for mechanically restraining said connecting means at least against shifting out of said lost motion state toward said positive motion state;

wherein said second cam includes a base circle portion and a lobe portion radially extending from said base circle portion; and wherein said mechanically restraining means includes a groove formed in said base circle portion of said second cam, a timing lever mounted on said rocker arm and having a follower portion arranged to engage said base circle portion and said groove, a spring arrangement for biasing said timing lever to maintain said follower portion of said timing lever in engagement with said second cam.

19. An apparatus as claimed in claim 18, wherein said timing lever has one end portion.

20. An apparatus as claimed in claim 19, wherein said rocker arm has a pivot shaft and said second cam follower is pivotally mounted on said pivot shaft of said rocker arm.

21. An apparatus as claimed in claim 20, wherein timing lever has an opposite end portion pivotally mounted on said pivot shaft of said rocker arm.

22. An apparatus as claimed in claim 21, wherein said timing lever is disposed between said second cam follower and said rocker arm.

23. An apparatus as claimed in claim 22, wherein said locking bolt has one end engageable with said one end portion of said timing lever when said locking bolt is in said unlocking position.

24. An apparatus as claimed in claim 23, wherein said locking bolt is formed with a groove engageable with said one end portion of said timing lever when said locking bolt is inserted into said second bore and in said locking position.

25. An apparatus as claimed in claim 24, wherein said second bore is a through bore.

26. An apparatus as claimed in claim 23, wherein said connecting means includes a third bore formed in said rocker arm, and said resiliently biasing means includes a plunger disposed in said second bore, a spring retainer disposed in said third bore, and a return spring disposed in said third bore and acting on said spring retainer.

27. An apparatus according to claim 18 wherein the second cam follower is pivotally mounted on said rocker arm.

28. An apparatus comprising:

a rocker shaft;

a first cam;

a second cam;

a rocker arm pivotally mounted on said rocker shaft, said rocker arm including a first cam follower arranged to engage said first cam, said rocker arm including a second cam follower, said second cam follower being arranged to engage said second cam;

means for connecting said second cam follower to said rocker arm for a unitary motion, said connecting means having a positive motion state wherein said rocker arm moves with said second cam follower as a unit as said second cam follower follows said second cam and a lost motion state wherein said rocker arm fails to move as a unit with said second cam follower, said connecting means being shiftable between said positive motion state and said lost motion state;

means for mechanically restraining said connecting means at least against shifting out of said lost motion state toward said positive motion state; and wherein said mechanically restraining means includes a timing lever pivotally mounted on said second cam follower and having one end portion and an opposite follower end portion arranged to engage said second cam.

29. An apparatus according to claim 28 wherein the second cam follower is pivotally mounted on said rocker arm.

30. An apparatus as claimed in claim 28, wherein said mechanically restraining means includes a spring arranged to maintain said opposite follower end portion of said timing lever in engagement with said second cam.

31. An apparatus as claimed in claim 30, wherein said second bore is a through bore.

32. An apparatus as claimed in claim 31, wherein said connecting means includes a third bore formed in said rocker arm, and said resiliently biasing means includes a plunger disposed in said second bore, a spring retainer disposed in said third bore, and a return spring disposed in said third bore and acting on said spring retainer.

33. An apparatus as claimed in claim 32, wherein said plunger cooperates with said one end portion of said timing lever.

34. An apparatus as claimed in claim 33, wherein said plunger is formed with a first groove engageable with said one end portion of said timing lever when said locking bolt is inserted in said second bore and in said unlocking position.

35. An apparatus as claimed in claim 34, wherein said plunger is formed with a second groove engageable with said one end portion of said timing lever when said locking bolt is in said locking position.

* * * * *